US011576442B1

(12) United States Patent
Jones

(10) Patent No.: US 11,576,442 B1
(45) Date of Patent: Feb. 14, 2023

(54) UNBRA BREAST PILLOW

(71) Applicant: Dorothy Jones, West Sacramento, CA (US)

(72) Inventor: Dorothy Jones, West Sacramento, CA (US)

( * ) Notice: Subject to any disclaimer, the term of this patent is extended or adjusted under 35 U.S.C. 154(b) by 0 days.

(21) Appl. No.: 15/813,155

(22) Filed: Nov. 15, 2017

Related U.S. Application Data

(60) Provisional application No. 62/497,513, filed on Nov. 22, 2016.

(51) Int. Cl.
*A41C 3/00* (2006.01)
*A41C 3/14* (2006.01)

(52) U.S. Cl.
CPC ..... *A41C 3/0021* (2013.01); *A41C 3/142* (2013.01)

(58) Field of Classification Search
CPC ..... A41C 3/0057; A41C 3/0021; A41C 3/142
USPC ..... 450/54–57, 37–39, 88
See application file for complete search history.

(56) References Cited

U.S. PATENT DOCUMENTS 1,179,137 A * 4/1916 Orr ..... A41C 3/0028 450/69
1,871,106 A * 8/1932 Yerkes ..... A41C 3/06 450/84
2,498,487 A * 2/1950 Solomon ..... A41C 3/06 450/78
2,897,821 A * 8/1959 Lerner ..... A41D 7/001 450/55
3,595,243 A * 7/1971 Mount ..... A41C 3/0007 450/5
4,217,905 A * 8/1980 Atwater ..... A41C 3/0057 450/74
4,355,641 A * 10/1982 Dastoli ..... A41C 3/04 450/36
D366,351 S * 1/1996 Winchell ..... D2/706
8,911,416 B2 * 12/2014 Johnson ..... A41D 27/12 604/385.07
2010/0120329 A1 * 5/2010 MacDonald ..... A41C 3/0021 450/40

* cited by examiner

*Primary Examiner* — Gloria M Hale

(57) ABSTRACT

The U-Bra Breast Pillow is a strapless women's undergarment that fits around the breast area, fastens in the back, and has a unique memory foam pillow attachment in the front which tucks under large breasts to provide a natural lift. The front center gathering provides comfortable breast separation, adornment, and style. It is a complete breast covering bandeau with an attached under-breast memory foam technology that lifts the breasts and contours the chest without straps, underwire, or buckles. The U-Bra Breast Pillow system aims to contribute positive effects on the back, neck, and shoulder areas by relieving top-heavy tension, defying gravity with frontal support and alleviating tight, downward pulling strap marks from the shoulders that often causes discomfort for individuals with a large, well-endowed chest area. It elevates unsightly sagging breasts, promotes fullness, and provides a sense of freedom and confidence for a fuller, more voluptuous appearance.

3 Claims, 5 Drawing Sheets

FRONT VIEW 6
7
8

UNBRA BREAST PILLOW

BACKGROUND OF THE INVENTION

The invention relates to an undergarment breast band covering the breast area with a unique memory foam pillow lift. The U-Bra Breast Pillow system is a unique nontraditional bra or undergarment that enables users to customize the selection, style, and usage. The selection and customization can occur at the point of purchase. Interchangeable customization can be based upon size, shape, and colors. A user's compatibility, choice, and selection can be worn as under or outer wear.

Women's under garments and particularly bras, have become a major part of fashion industry. As more and more bra types, functions, purposes, and designs of bras are available today, consumers naturally attempt to find the undergarment with the optimum combination of style and comfort to meet their special or specific needs. As women get older, they begin to experience gravity working against them. Breast appear heavier often causing shoulder pain, back pain, and upper body discomfort. Women often find themselves wanting to go braless, however, they really don't like the visible and unappealing shape of their breast just hanging low, unshapely, unsupported, and sagging. This invention conforms and molds itself to the user's shape and upper torso, thereby allowing for a comfortable and secure fit and lift due to the bandeau, breast band shape.

In today's market, women find the structure of the traditional bra, and their related accessory components; confining, restricting and in some cases bruising to the shoulders, back area and underarms. The traditional bra is usually constructed with shoulder straps, underwire, and back straps. Women have often found these binding, uncomfortable, and restrictive. The solution to problems that some traditional bras can cause, is the U-Bra Breast Pillow.

The U-Bra Breast Pillow is a unique undergarment designed to free, uplift, and support the breasts from underneath without harsh wires, tight straps or binding materials. It is a revolutionary design that is comfortable, unrestrictive, simple, and easy to use. It is a pillow like ledge of support that works as a stand-alone undergarment, or as an additional piece and component to the traditional bra unit. The U-Bra Breast Pillow is a strapless women's undergarment that fits around the breast area and fastens in the back. The front has an attached, enclosed, memory foam padding pillow that tucks under the breasts to provide natural and strap free lift. The center front gathering provides breast separation, adornment, and style. It is a complete breast covering bandeau with an attached under breast memory foam casing/technology that lifts the breast, and contours the breast area without straps, underwire, or buckles.

It is estimated that about 75-80% of women have trouble with proper bra fittings, measurements, and selections. Even with some specific breast measurements, it is difficult to use one measurement due to various types of bras which include: plunges, full cups, half cups, pushups, fashionable, fitting, well-fitting, sports, and string pull-up bras, and more. The various bra types often require a different measurement and cup size for each traditional bra style. For example, where a user might wear a 36 D in a "Full Cup Bra", the same user might be a 36DDD or 36G in a "Plunge Bra". This is a problem that had been known to cause frustration and confusion for the ladies, young woman, and girls since the invention of the traditional bra.

Over time, woman's breast size may change significantly, particularly during and after pregnancy. Other factors include weight loss, weight gain, menopause, and menstrual cycle with body weight variations. All of which can influence the fit, look, and appeal of the traditional bra. As women begin to mature, they are looking for comfort, uniqueness, simple solutions, and liberating style and experience. Over the years, along with life changes, women find themselves with an over whelming desire to just simply go free and braless. Girls begin wearing traditional bras at puberty, ages 10-12 typically. Women can easily say they wear bras most of their life from age 10-80 on average. This results in seventy years or more of being bound up, restricted, and harnessed around the breast area for a vast spectrum of their lives. On an average work or school day, a woman or young girl wears the traditional bra for about 42% of her day, and the first thing she wants to do when she gets home is to take the traditional bra off. However, the older or well-endowed woman really don't care for the look and appearance of sagging breasts as it is unattractive and unappealing even around the house in the presence of their mate, children, or love ones. Now with the Un-Bra Breast Pillow, users can wear this band-like undergarment that has a special breast pillow lift from underneath as a welcomed replacement to the traditional bra. At the end of the day ladies can easily change from the traditional bra to the Un-Bra Breast Pillow in a way that eliminates drooping or sagging breasts.

BRIEF SUMMARY OF INVENTION

The essential purpose of the U-Bra Breast Pillow is to provide comfort, support, and freedom from the traditional restrictions in a way that defy gravity, provide a breast-band under-lift pillow support where the breast can simply rest. This is done in a way that takes the stress and pressure off the shoulders & back; while providing extreme comfort, lift, and support thereby reducing the appearance of sagging breasts. Un-Bra Breast Pillow is designed as an under support without straps. The band, contour, and lift like no other undergarment. A spandex bodice/tube or bandeau surrounds the breasts, sides, and upper back area; as the unique memory foam is positioned, rolled, and placed under and in-between the crease of the under breast and rib cage. It extends horizontally from side to side providing a comfortable hug surrounding the upper torso.

The U-Bra Breast Pillow extends from far-left side of the under breast to the far-right side of the under breast. Each breast will lay on top of the memory foam breast pillow. Well-endowed women may simply rest their breasts on top and fold breasts over the memory foam ledge pillow.

The U-Bra Breast Pillow enables users to customize their selection in size and varying degrees of lift firmness; soft, medium, or firm). The memory foam breast pillow lifts will allow ladies breasts to defy gravity, provide a natural lift, while promoting voluptuous support, with the appearance of reduced sagging, without shoulders aches, straps, and back discomfort. The selection and customization can occur at the point of purchase. U-Bra Breast Pillow invention and design focuses on supporting and lifting the breast from underneath. With this design, the breast can simply rest on the Un-Bra memory foam lift. The functionality of the U-Bra Breast Pillow allows the user to escape the traditional bra with straps, wires, and cups. This allows the user to feel good about their form, posture, and support. U-Bra Breast Pillow targets and relates to the full figured, well-endowed women, who over time with the assistance of gravity tend to sag in their bosom. However, customization can take place to support petite women as well. This invention can be used within an interchangeable system, or as a stand-alone in your existing undergarments. This invention will allow ladies to defy gravity, provide a natural lift, promoting voluptuous support, without shoulders straps and back discomfort. The U-Bra Breast Pillow also supports a cooling/absorbent feature that eliminates under breast drips and sweat thereby reducing body heat.

DRAWINGS—REFERENCE NUMBERS

Figure 1:
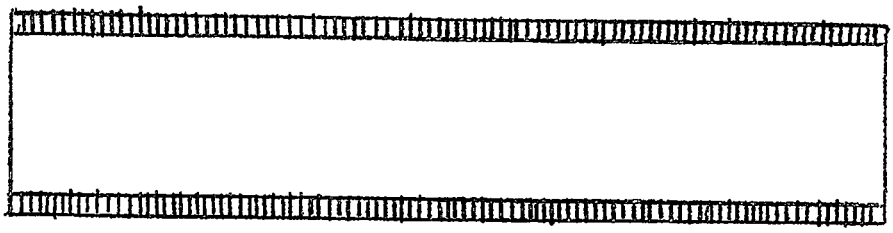
FIG. 1 Is a front view of the rectangle breast band (bandeau fabric) with ribbing on top and bottom

1 Basic rectangle shaped spandex fabric; Bandeau Bodice: 92% Nylon 8% Spandex With ribbing at the top & bottom of the rectangle shaped fabric

1A Embodiment of the invention and design

2 Is a front-open view of the present invention displaying the far-right side and the far left side hook and eye

3 Customized memory foam under-breast pillow lift

4 Outer memory foam covering/casing for memory foam lift insert

5 Contrasting binding tape for gathering

6 Hook tape (of the hook & eye closure)

7 Eye tape (of the hook and eye closure)

8 Size and care instruction label

DETAILED DESCRIPTION OF INVENTION/DRAWINGS

Referring to the drawings, 1A there is illustrated an invention in the embodiment of an Un-Bra Breast Pillow according to the present invention being indicated generally by the reference number 1. The invention 1 comprises a one-piece rectangle shaped fabric that is gathered five to six inches in the front center of the garment and stabilize and sewn with contrasting binding tape 5. The foam insert 3 is covered, encased, surrounded and sewn in fabric 4; once 3 and 4 become one piece, it is then centered and attached at the bottom of 1A. Far-left end of the garment is gathered and adjusted to fit four inches, then far-left gathered end is affixed/sewn to hook tap 6. Far-right end of the garment is gathered and adjusted to fit 4 inches, then far-right gathered end is affixed/sewn to right eye tape 7.

2 is an open view that surrounds the entire breast area and is closed by hook and eye tape closure 6 and 7. The view 2 is gathered in the middle creating a four-inch gathering in the front middle of the breast area and the gathering is secured with 5 binding tape. The left and right end of 2 is gathered five inches on each side to affix 6 and 7 on each end in a way that lines up the hooks and closes together. The memory foam 3 is covered, surrounded, and encased in 4, memory foam covering. Once encased, 3 and 4 are affixed and sewn to the front, middle, bottom of 2 basic fabric. A care and instruction label is located in the back/right side of the garment 8.

Referring to FIG. 1, the view of FIG. 1. It can be seen that 1 is a view of a rectangle shaped spandex fabric with ribbing at the top and bottom of the material.

Figure 1A:
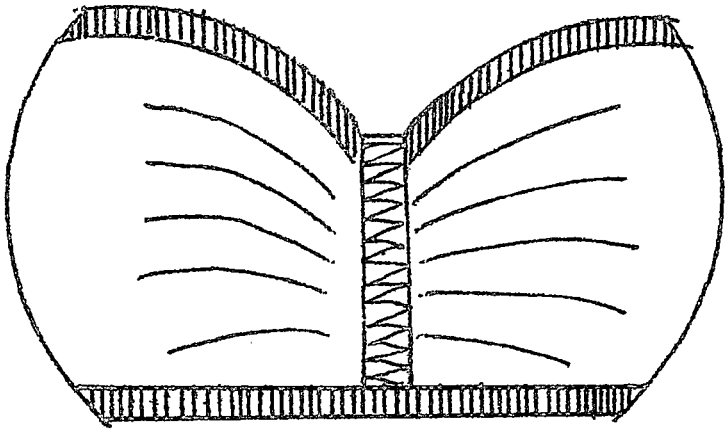
FIG. 1A is a front view of invention FIG. 2 Is a front-open view of the present invention displaying the right side and left side view along with the back/rear hook & eye closure FIG. 3 Customized memory foam under-breast pillow lift FIG. 4 Casing for Memory Foam Lift FIG. 5 1-2" binding tape for center gathering support FIG. 6 4-5" Left Back Hook (of the hook and eye)

Referring to FIG. 1A, it can be seen that the front view, illustrates the invention in the embodiment of the design showing that the breasts are embraced and surrounded by the garment in a way that molds and contours to the bosom and provides a breast pillow lift from underneath.

Figure 2:
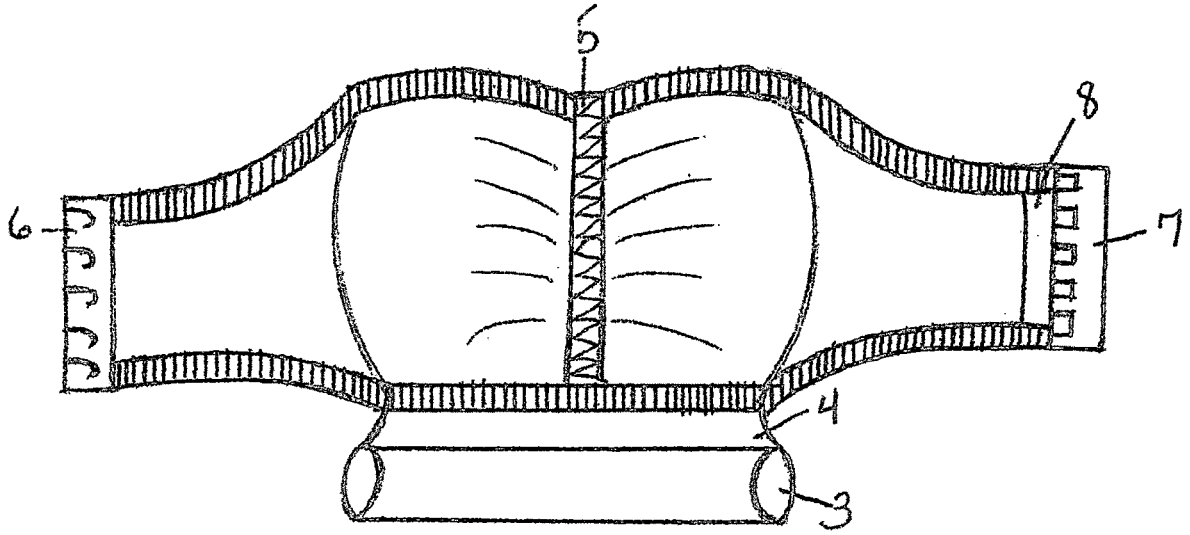

Referring to FIG. 2, It can be seen that this is a front open view of garment that extend Wide from the far-left side of the garment to the far-right side of the garment. The far-left rear view 6 is gathered and secured with hook tape; and 7 far-right rear view gathered and secured with eye tape. Memory foam 3 is incased in spandex fabric 4. Once 3 and 4 are inserted, affixed and attached, it is position and sewn to the center front bottom of ribbing 1*a*. The front middle of the garment is gathered in the middle and secured with contrasting binding tape.

Figure 3:
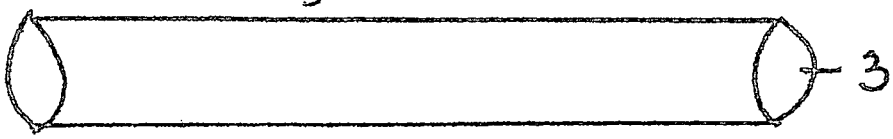

Referring to FIG. 3, It can be seen that the invention embodies a unique customized memory foam cylinder pillow insert for an under-breast lift. Foam can be soft, medium or firm. These can be customized to provide the desired firmness in the lift. Unique foam insert lift to provide firm support under the breast.

Figure 4:
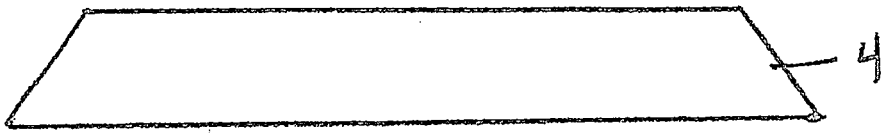
FIG. 7 4-5" Right Back Eye (of the hook and eye)

Referring to FIG. 4, It can be seen that this is the casing fabric 4 for this invention completely covers 3 and is ultimately sewn or attached to the bottom of 2. Once 3 & 4 are attached, they are inserted and rolled underneath both breasts for a unique support and lift.

Figure 5:
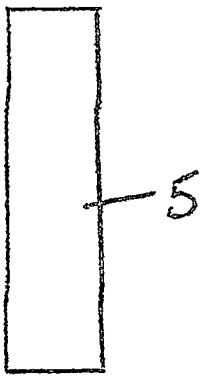

Referring to FIG. 5, It can be seen that the binding that hold and secures the gathering in the middle of the garment which contours both the right and left side of each breast.

Figures 6, 7, 8:
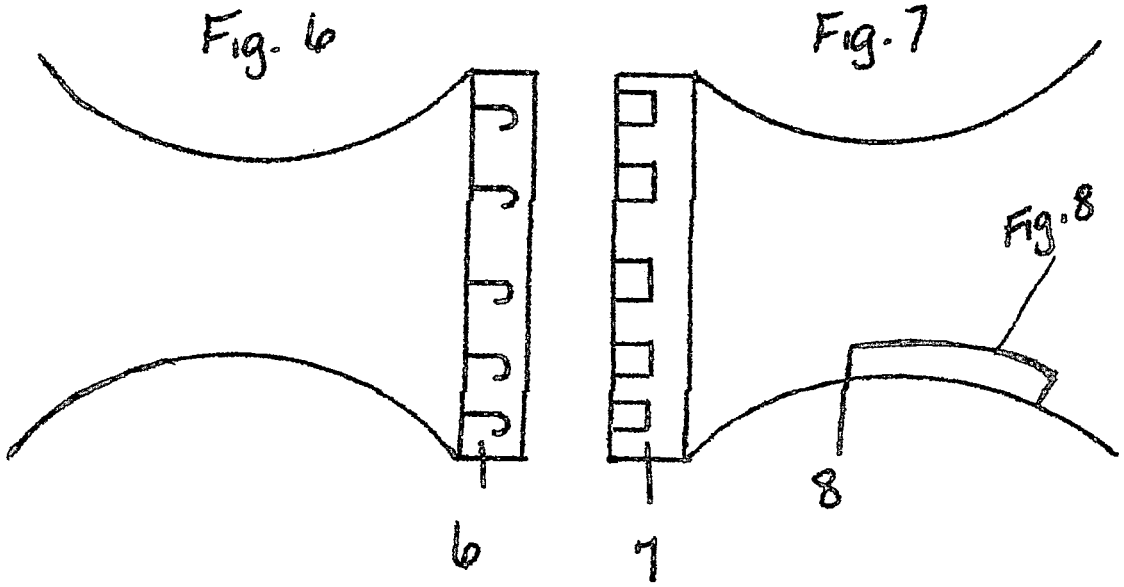
FIG. 8 Care and instruction label

Referring to FIG. 6, It can be seen that the rear view of the left side-hook tape. And a rear side gathered ends of 2.

Referring to FIG. 7, It can be seen that is a rear view of the right side-eye. And a rear side gathered ends of 2.

Referring to FIG. 8, Care and instruction label.

Bodice Size/Fitting

One size fits most or size chart below

7" Bodice is for Small, Medium and Large size women

10" Bodice is for XL, XXL, XXXL

11"+ plus is for custom orders

U-Bra Breast Pillow Memory Foam Lift Measurements:

1. Diameter: Un-Bra Memory Foam Lift: 1", 2", 3", 4", 5", 6", 7", 8" 9" 10",

| Size | Bust Size | Lift size | Shirt/ Blouse Size | Bra/Cup Size |
|---|---|---|---|---|
| XS/ S/M | 31-35 | 1" | 2, 4 | 32A, 32B |
| M | 35-37 | 1" | 6, 8 | 32C, 32D, 34A, 34B |
| L | 37-40 | 2" | 10, 12 | 32DD, 32DDD, 34C, 34D, 34DD, 36A, 36C, 36C, 38A |
| XL/ 1X | 40-43 | 2" | 14, 16 | 34DDD, 36D, 36DD, 36DDD, 38B, 38C, 38D, 40A, 40B |
| 2X | 43-46 | 3" | 16W, 18W | 38DD, 38DDD, 40C, 40D, 40DD, 42A, 42B, 42C, 44A |
| 3X | 46-50 | 3" | 20W, 22W | 40DDD, 42D, 42DD, 42DDD, 44B, 44C, 44D, 44D |
| 4X | 50-54 | 4"+ | 22W, | 44DDD, 46D, 46DD, 46DDD, 48D, 48C, |

-continued

| Size | Bust Size | Lift size | Shirt/ Blouse Size | Bra/Cup Size |
|---|---|---|---|---|
| | | | 24W | 48D, 48DD |

The invention claimed is:

1. A strapless tubular bandeau brassiere for supporting breasts of a wearer comprising a tubular strapless brassiere having a front panel and left and right panels that connect at a center back of said brassiere with a hook and eye closure; said front and rear panels are formed of a fabric; said front panel having a left breast covering portion and a right breast covering portion with a stabilizing band attached to an inner surface of said front panel by stitching that gathers said front panel and wherein said gathered front portion is configured to lie between the breasts of said wearer; said front panel includes a cylindrical memory foam pillow that is covered by a casing fabric: said tubular memory foam pillow is configured to support the breasts of said wearer and lies under said wearer's breasts to provide a shelf support to said wearer's breasts.

2. A strapless tubular bandeau brassiere for supporting the breasts of a wearer as claimed in claim 1 wherein said front and rear fabric panels are constructed of 92 percent nylon and 8 percent spandex fabric in order to provide secure supportive fit on said wearer.

3. A strapless tubular bandeau brassiere for supporting the breasts of a wearer as claimed in claim 1 wherein said cylindrical memory foam pillow is provided in a memory foam selected from different support levels including any one of a soft, medium or firm memory foam.

* * * * *